US006756860B2

(12) United States Patent
Shin

(10) Patent No.: US 6,756,860 B2
(45) Date of Patent: Jun. 29, 2004

(54) DUAL BAND COUPLER

(75) Inventor: Ji Hwan Shin, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 15 days.

(21) Appl. No.: 10/212,223

(22) Filed: Aug. 6, 2002

(65) Prior Publication Data

US 2003/0117230 A1 Jun. 26, 2003

(30) Foreign Application Priority Data

Dec. 21, 2001 (KR) ..... 2001-82529

(51) Int. Cl.[7] ..... H01P 3/08; H01P 5/12; H01P 5/18

(52) U.S. Cl. ..... 333/116; 333/109; 333/238; 333/246

(58) Field of Search ..... 333/109–116, 238, 333/246, 117

(56) References Cited

U.S. PATENT DOCUMENTS 5,359,304 A * 10/1994 Fujiki ..... 333/116
5,369,379 A * 11/1994 Fujiki ..... 333/116
5,382,925 A * 1/1995 Hayashi et al. ..... 333/112
5,467,064 A * 11/1995 Gu ..... 333/128
5,557,245 A * 9/1996 Taketa et al. ..... 333/116
5,742,210 A * 4/1998 Chaturvedi et al. ..... 333/116
5,841,328 A * 11/1998 Hayashi ..... 333/116
5,952,970 A * 9/1999 Kawahata ..... 343/700 MS
6,515,556 B1 * 2/2003 Kato et al. ..... 333/116
6,642,809 B2 * 11/2003 Shin et al. ..... 333/116

* cited by examiner

*Primary Examiner*—Michael Tokar
*Assistant Examiner*—Nguyen Khai
(74) *Attorney, Agent, or Firm*—Lowe Hauptman Gilman & Berner LLP

(57) ABSTRACT

Disclosed is a dual band coupler, in which a dielectric layer having a coupling signal line is positioned between dielectric layers having a first main signal line and a second main signal line. Coupling coefficients of first and second signal lines can be independently controlled by laminating different numbers of dielectric layers between the coupling signal line and main signal lines, respectively. A shielding pattern for excluding mutual electromagnetic interference between the first and second main signal lines is formed on the dielectric layer having the coupling signal line to improve an isolation, and a small sized-dual band coupler can be provided because the dielectric layer having a ground pattern can be omitted.

20 Claims, 6 Drawing Sheets

DUAL BAND COUPLER

BACKGROUND OF THE INVENTION

1. Field of the Invention

The present invention relates to a dual band coupler and, in particular, to an improvement in design freedom of a dual band coupler, in which coupling coefficients of two main signal lines can be independently controlled.

2. Description of the Prior Art

Generally, A coupler used in a mobile telecommunication terminal device transmits a signal at a constant output through an antenna by distributing a transmitting signal in a proper ratio, or by taking a constant output signal from an amplifier of a transmitter and transmitting the signal to a automatic phase controller (APC).

With the need for multi-functional and small-sized mobile telecommunication terminal devices, dual band or triple band terminals are widely spread, which are characterized by the simultaneous service of two or more frequencies in one device. Accordingly, there is a strong demand for parts that can treat two different frequency bands. In response to such demand, dual band couplers have been developed.

In order to better understand the background of the invention, a detailed description will be given of a conventional dual band coupler in conjunction with drawings, below.

FIG. 1 is an equivalent circuit of a conventional dual band coupler. With reference to FIG. 1, the dual band coupler comprises a first main signal line 2 and a second main signal line 3 connected to an output amplifier of a transmitter treating different frequency band signals, and a coupling signal line 4 taking a predetermined amount of signal and adjacent to the first and second main signal line. The first and second main signal line 2 and 3 are provided with input IN1 and IN2 and output OUT1 and OUT2 terminals, and the coupling signal line 4 takes samples of input signals from different positions of the first and second main signal line 2 and 3 and transmits them to the automatic phase controller.

The dual band coupler forms a multiple layer type coupler consisting of multiple dielectric layers in order to provide a small-sized coupler.

FIG. 2 is an exploded perspective view of the conventional dual band coupler. Referring to FIG. 2, the dual band coupler comprises a first and fifth dielectric layer 11 and 15 having ground patterns 21 and 25; a second and third dielectric layer 12 and 13 having the first and second main signal lines 22*a* and 22*b*, 23*a* and 23*b*; and a fourth dielectric layer 14 having coupling signal lines 24*a* and 24*c*. The second and third dielectric layers 12 and 13 comprise two laminated dielectric layers 12*a* and 12*b*, 13*a* and 13*b*, and electrode patterns formed on dielectric layers, i.e. signal lines 22*a* and 22*b*, 23*a* and 23*b*, are connected to each other through conductive via-holes h1 and h2. Furthermore, the fourth dielectric layer 14 consists of two laminated dielectric layers 14*a* and 14*b*, and signal lines 24*a*, 24*b*, and 24*c* formed on the dielectric layers 14*a* and 14*b* are connected to each other through conductive via-holes h3 and h4. In addition, both ends of signal lines connected to each other through via-holes are extended to edges of dielectric layers to be connected to a lateral terminal, which will be formed in a subsequent process.

However, conductive patterns constituting signal lines should be formed at different positions on dielectric layers in order to shield mutual electromagnetic interference between the first and second main signal lines. Therefore, an area, in which the signal line is formed, becomes relatively small, and so precision patterning is needed. As a result, production cost and rejection rate are increased.

Additionally, in a conventional dual band coupler of FIG. 2, it is hard to independently control coupling coefficients of the first 22 and second 23 main signal line. In a multiple layers type coupler, the coupling coefficient is defined as a thickness of the dielectric layer inserted between main signal lines and an inductance owing to a signal line pattern.

As described above, however, the dual band coupler does limitedly form the signal line pattern, and so the coupling coefficient cannot be desirably controlled. Also, in case of controlling the thickness of the dielectric layer, when the thickness t of the dielectric layer 14*a* of the fourth dielectric layer is controlled in order to control the coupling coefficient of the second main signal line 23, thicknesses of dielectric layers of the first main signal line 22 and the coupling signal line 24 are also varied. Therefore, the coupling coefficient of the first main signal line 22 is considered, thereby, it is very difficult to design the desired dual band coupler having various coupling coefficients required in mobile telecommunication terminal devices.

Therefore, there remains a need for a dual band coupler, which can independently control a coupling coefficient of the first and second main signal line.

SUMMARY OF THE INVENTION

Therefore, the primary object of the present invention is to overcome the above disadvantages encountered in prior arts, and to provide a dual band coupler, which can independently control a coupling coefficient of a first and second signal line by laminating a dielectric layer having a coupling signal line between dielectric layers having a first and second main signal line so that dielectric layers between the coupling signal line and main signal lines have a different thickness from each other, or by laminating different numbers of dielectric layers between the coupling signal line and main signal lines, respectively.

Another object of the present invention is to provide a dual band coupler, which has an improved isolation by forming a shielding pattern for excluding mutual electromagnetic interference between the first and second main signal line on the dielectric layer having the coupling signal line.

Based on the present invention, the above objects can be accomplished by a provision of a dual band coupler, comprising: a first ground pattern formed on a first dielectric layer; a first main signal line having a first input and output terminal, which is a conductive pattern formed on a second dielectric layer laminated on the first dielectric layer; a coupling signal line having a coupling terminal and an isolation terminal, which is a conductive pattern formed on a third dielectric layer laminated on the second dielectric layer; a second main signal line having a second input and output terminal, which is a conductive pattern formed on a fourth dielectric layer laminated on the third dielectric layer; and a second ground pattern formed on a fifth dielectric layer laminated on the fourth dielectric layer.

According to an embodiment of the present invention, a dielectric layer between the first main signal line and the coupling signal line is made to be different in thickness from a dielectric layer between the second main signal line and the coupling signal line, or dielectric layers between the coupling signal line and the first main signal line are different in number from the dielectric layers between the coupling signal line and the second main signal line, whereby the coupling coefficient of each main signal line can be independently controlled.

According to another embodiment of the present invention, an isolation between the first and second main signal line can be improved by providing a dual band coupler further comprising a shielding pattern for excluding electromagnetic interference between the first and second main signal lines. The shielding pattern is formed around the coupling signal line on the third dielectric layer so as to be separated from the coupling signal line.

According to another embodiment of the present invention, the second, third, and fourth dielectric layers may consist of plural layers. Particularly, when the third dielectric layer comprises plural layers, the third dielectric layer comprises three or more layers consisting of a first layer having the coupling terminal, on which the first conductive pattern is formed; a second layer having the isolation terminal, on which the second conductive pattern is formed; and a third layer formed between the first and second layer, on which the third conductive pattern connecting the first conductive pattern to the second conductive pattern is formed. The first, second, and third conductive patterns are connected to each other through via-holes. It is preferable that the shielding pattern is formed around the third conductive pattern on the third layer so as to be separated from the third conductive pattern. The reason is that coupling signal lines on dielectric layers having the coupling terminal and the isolation terminal are extended to edges of dielectric layers, and so the shielding pattern is hard to surround the third conductive pattern. When the shielding pattern does not surround the third conductive pattern, a shielding effect may be reduced. In addition, the shielding pattern comprises two ground terminals.

Furthermore, a small-sized dual band coupler may be obtained by omitting dielectric layers having only the ground pattern. The dual band coupler comprises the first main signal line having the first input and output terminal, formed on the first dielectric layer; the coupling signal line having the combined output terminal and the isolation output terminal, formed on the second dielectric layer laminated on the first dielectric layer; and the second main signal line having the second input and output terminal, formed on the third dielectric layer laminated on the second dielectric layer. The dual band coupler has the ground pattern formed on the second dielectric layer so as to be separated from the coupling signal line. The ground pattern shields electromagnetic interference between the first and second main signal line.

When the third dielectric layer consists of plural dielectric layers, it is preferable that the ground pattern is formed on the dielectric layer having only the coupling signal line without the isolation and coupling terminal.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PRESENT INVENTION

Figure 1:
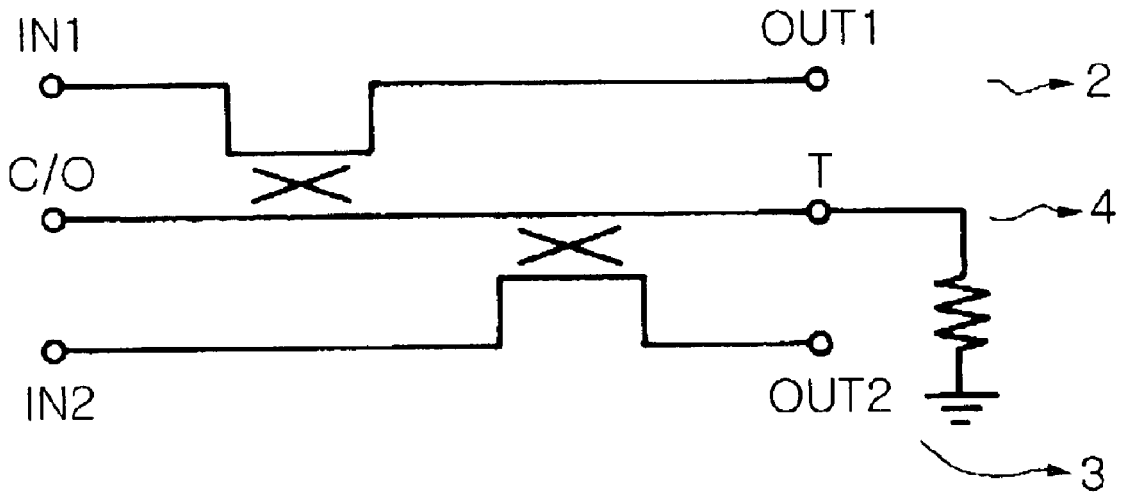
PRIOR ART FIG. 1
FIG. 1 is an equivalent circuit of a conventional dual band coupler.
Figure 2:
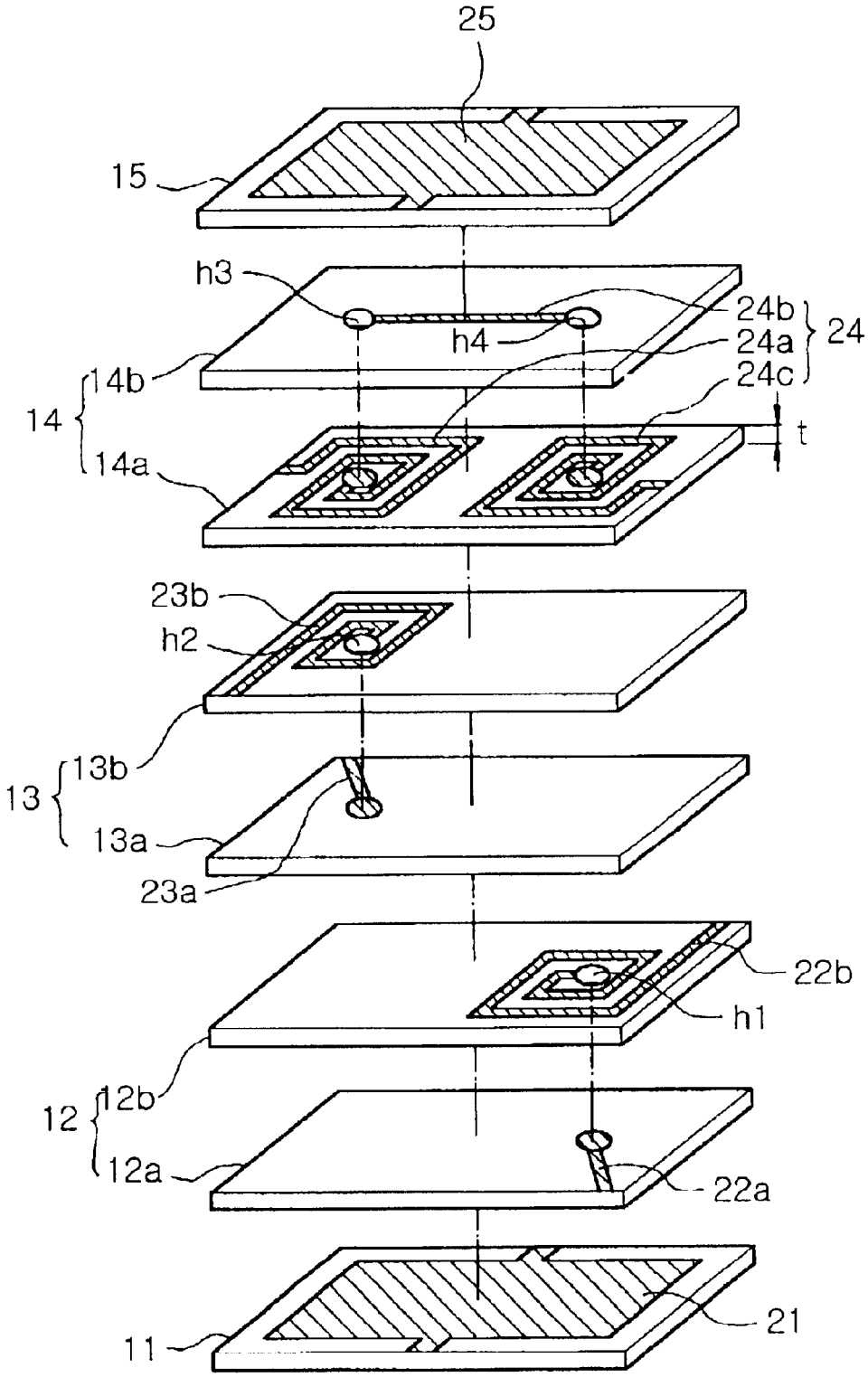
PRIOR ART FIG. 2
FIG. 2 is an exploded perspective view of the conventional dual band coupler.

The application of the preferred embodiments of the present invention is best understood with reference to the accompanying drawings, wherein like reference numerals are used for like and corresponding parts, respectively.

Figure 3A:
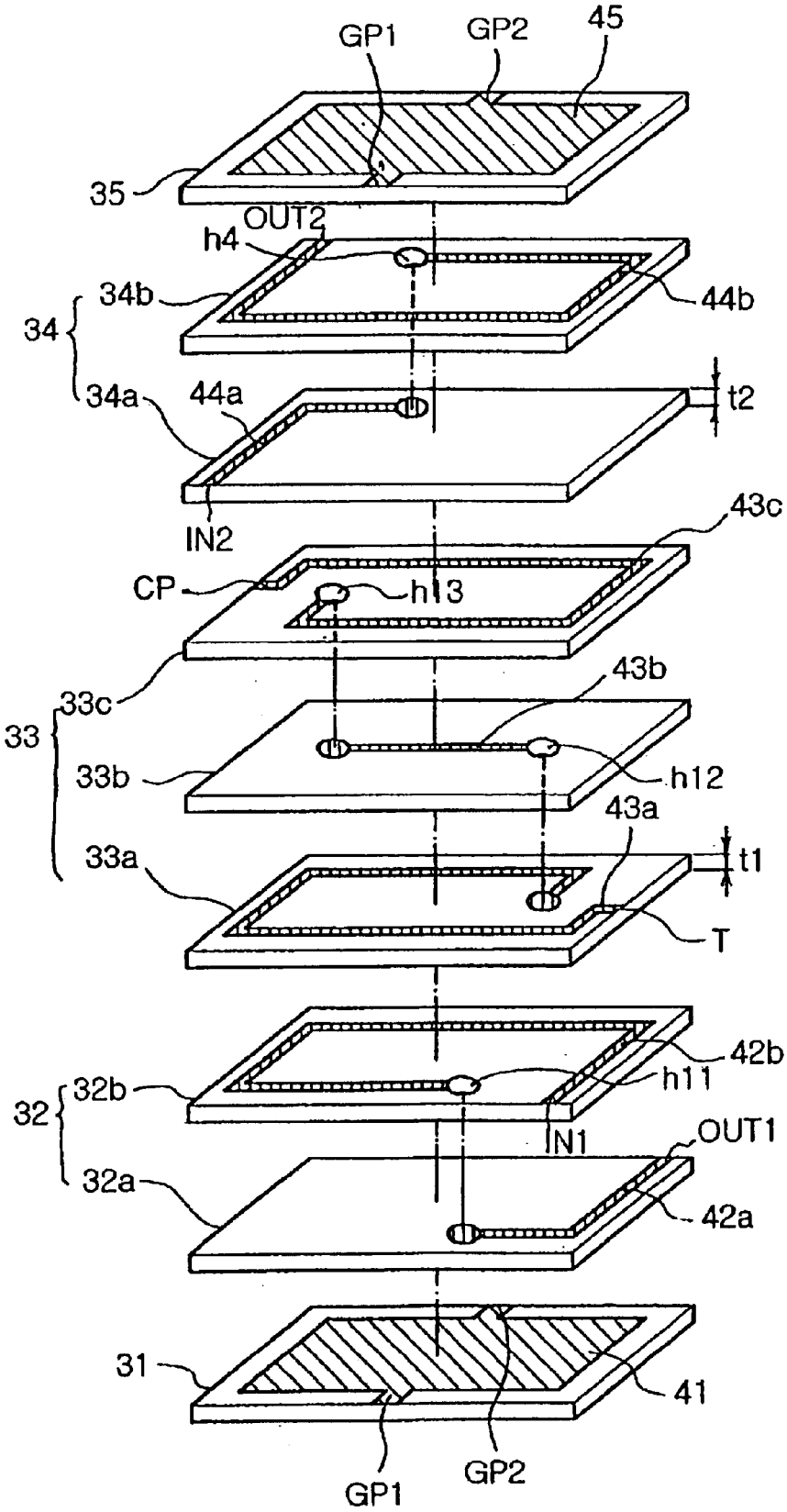
FIGS. 3*a* and 3*b* are perspective views of a dual band coupler according to an embodiment of the present invention.

FIG. 3*a* is an exploded perspective view of a dual band coupler according to an embodiment of the present invention. Referring to FIG. 3*a*, the dual band coupler has a structure, in which ground patterns 41 and 45, a first and second main signal line 42 and 44, and a coupling signal line 43 are formed on nine dielectric layers 31 to 35. The ground patterns 41 and 45 are formed on a first dielectric layer 31 and a fifth dielectric layer 35, respectively, and the first and second main signal lines 42*a* and 42*b*, 44*a* and 44*b* are formed on a second dielectric layer 32 and a fourth dielectric layer 34, respectively. Furthermore, the coupling signal lines 43*a* to 43*c* are formed on third dielectric layers 33 positioned between the second and fourth dielectric layers 32 and 34.

According to an embodiment of the present invention, the second and the fourth dielectric layers 32 and 34 are each composed of two dielectric layers 32*a* and 32*b*, 34*a* and 34*b*, respectively, on each of which signal lines 42*a* and 42*b*, 44*a* and 44*b* consisting of conductive patterns are formed, and signal lines are connected to each other through conductive via-holes h11 and h14 to form the first and second main signal line 42 and 44. Also, the third dielectric layer 33 is composed of three dielectric layers 33*a* to 33*c*, and signal lines 43*a* to 43*c* formed on dielectric layers 33*a* to 33*c* are connected to each other through two conductive via-holes h12 and h13.

A lower dielectric layer 33*a* of the third dielectric layer 33 is positioned between the coupling signal line 43 and the first main signal line 42, and a lower dielectric layer 34*a* of the fourth dielectric layer 34 is positioned between the coupling signal line 43 and the second main signal line 44. Therefore, in order to determine a coupling coefficient, dielectric layers 33*a* and 34*a* positioned between main signal lines 42 and 44 and the coupling signal line 43 are controlled in thickness t1 and t2. Alternatively, the coupling coefficient may be determined by inserting additional dielectric layers between main signal lines 42 and 44 and the coupling signal line, and varying the thickness of dielectric layers.

According to the present invention, as described above, the coupling coefficients of the first and second main signal line 42 and 44 can be independently controlled by varying the thickness of the dielectric layer without changing of pattern of the signal line. Therefore, the coupling coefficients of main signal lines 42 and 44 can be easily controlled according to various needs in producing mobile telecommunication terminal device.

The number of dielectric layers in the second and fourth dielectric layers is not restricted in the present invention. As will be appreciated by those skilled in the art, the dielectric layer, on which signal lines are formed, can be variously constructed. The coupling coefficients of the main signal lines may be easily controlled by providing a dielectric layer having a coupling signal line between dielectric layers having the first main signal line and the second main signal line, respectively, without departing from the spirit and scope of the invention.

The first and second main signal line 42 and 44, and the coupling signal line 43 are extended to edges of dielectric layers to be connected to a lateral terminal, which will be formed in a subsequent process.

Figure 3B:
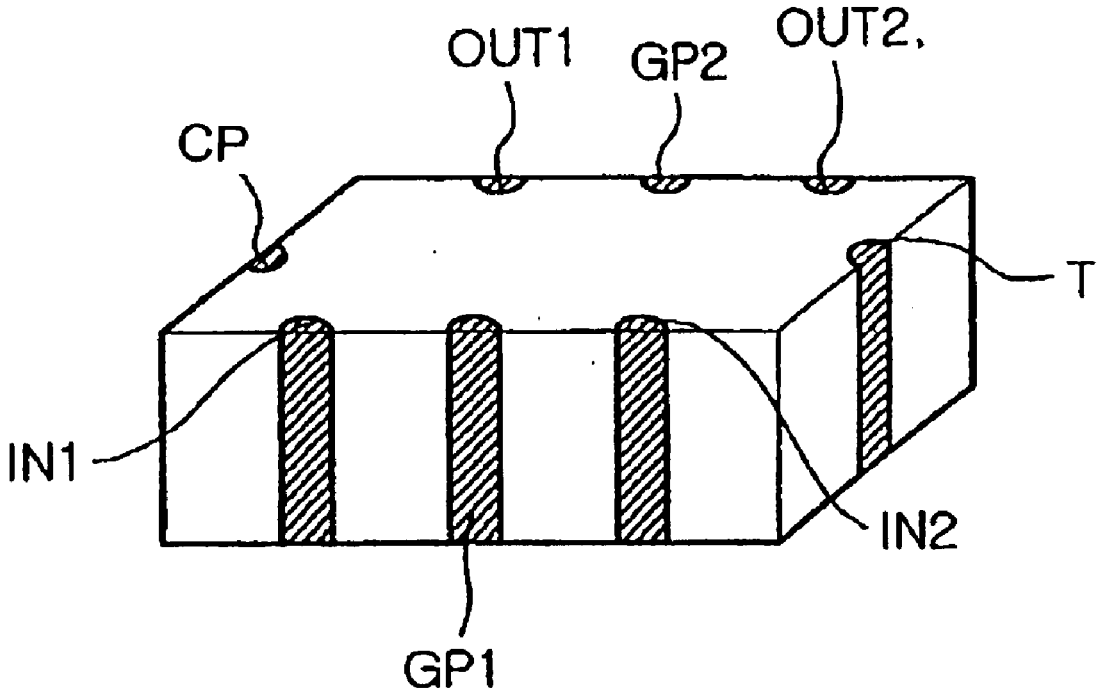

FIG. 3*b* illustrates a dual band coupler with the lateral terminal produced by laminating dielectric layers 31 to 35 shown in FIG. 3*a*. Referring to FIGS. 3*a* and 3*b*, the dual band coupler comprises two ground terminals GP1 and GP2 connected to the ground pattern extended to edges of the first and fifth dielectric layers 31 and 35; input and output terminals IN1 and IN2, OUT1 and OUT2 connected to ends of the first and-second main signal lines 42 and 43 extended to edges of the second and third dielectric layers 32 and 33; a coupling terminal CP and an isolation terminal T connected to ends of the coupling signal line 43 extended to edges of upper and lower layers 33*a* and 33*c* of the fourth dielectric layer. Terminals as described above may form penetration holes, side walls of which are covered with conductive materials.

According to another embodiment of the present invention, a dual band coupler is provided for improving an isolation by shielding a mutual electromagnetic interference between the first and second main signal lines.

Figure 4:
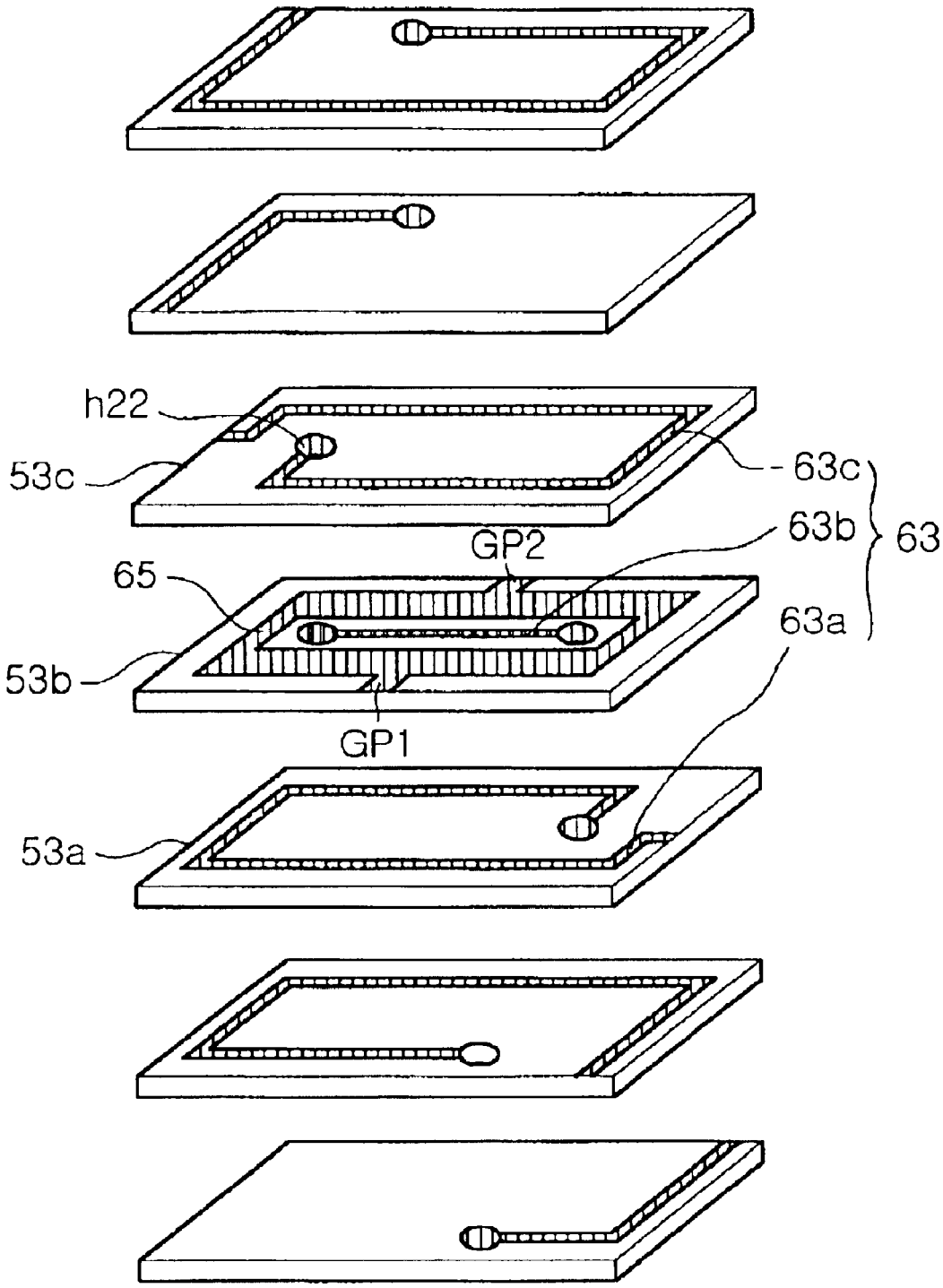
FIG. 4 is an exploded perspective view of a dual band coupler according to another embodiment of the present invention.

FIG. 4 is an exploded perspective view of the dual band coupler according to another embodiment of the present invention. As for FIG. 4, a detailed description will be given of only the dielectric layer 53 having the coupling signal line, which is a constitutional feature of the present embodiment. The dielectric layer 53 consists of three dielectric layers 53*a*, 53*b*, and 53*c*, and conductive patterns formed on dielectric layers 53*a*, 53*b*, and 53*c* are connected to each other through via-holes h21 and h22 to form one coupling signal line 63. A portion of the coupling signal line 63*b*, i.e. straight line shaped pattern, is formed on a middle dielectric layer 53*b*, and the shielding pattern 65 is formed around the combined signal pattern 63b on the middle dielectric layer 53*b* so as to be separated from the combined signal pattern 63*b*. The shielding pattern 65 is composed of general conductive materials shielding electromagnetic interference.

As described above, the shielding pattern 65 between the first and second main signal line excludes mutual electromagnetic interference occurring between the first and second main signal lines to improve the isolation.

In addition, the shielding pattern 65 may be used as the ground pattern without the first and fifth dielectric layers of FIG. 3*a*, and thus the isolation can be improved, and a small sized-dual band coupler, in which size of the dual band coupler is reduced by size corresponding to two omitted dielectric layers, can be provided.

The shielding pattern is positioned between the first and second main signal lines, and improves the isolation even though the coupling signal line is formed on any dielectric layer when the dielectric layer having the coupling signal line is plural. Also, the shielding pattern may be used as the ground pattern by forming only two ground terminals. But, when the dielectric layers are three or more, it is preferable that the conductive pattern is formed on only a middle dielectric layer to form the signal line.

Figure 5:
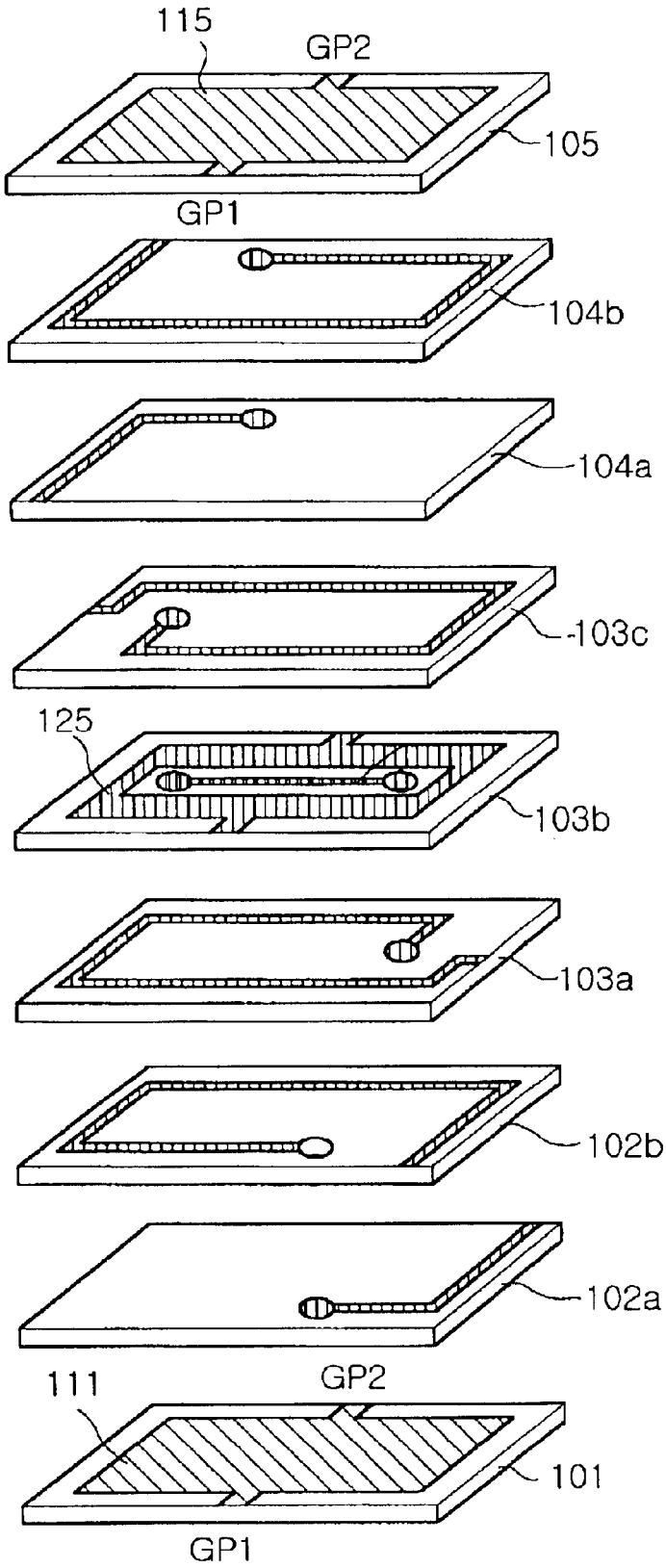
FIG. 5 is an exploded perspective view of a dual band coupler according to another embodiment of the present invention.

FIG. 5 is an exploded perspective view of a dual band coupler according to another embodiment of the present invention. The dual band coupler comprises a upper and lower dielectric layer 111 and 115, on which the ground pattern is formed; two first dielectric layers 102*a* and 102*b* having first main signal lines; three second dielectric layers 103*a*, 103*b*, and 103*c* having coupling signal lines; and two third dielectric layers 104*a* and 104*b* having second main signal lines. As shown in the present embodiment, dielectric layers 111 and 115 having the ground pattern may be additionally contained in the structure of FIG. 4. Dielectric layers 111 and 115 are provided with two ground terminals GP1 and GP2, respectively, and are used in conjunction with the dielectric layer 103*b* having the shielding pattern as a ground electrode.

As described above, the dual band coupler of the present invention has advantages in that the coupling coefficient of first and second signal lines can be independently controlled by laminating a dielectric layer having a coupling signal line between dielectric layers having a first and second main signal line so that dielectric layers between the coupling signal line and main signal lines have a different thickness from each other, or by laminating different number of dielectric layers between the coupling signal line and main signal lines. Another advantage of the dual band coupler of the present invention is that a pattern for shielding electromagnetic interference between the first and second main signal lines is formed on the dielectric layer having the coupling signal line to improve an isolation, and a small sized-dual band coupler can be provided because the dielectric layer having a ground pattern can be omitted.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A dual band coupler, comprising:

a first ground pattern formed on a first dielectric layer;

a first main signal line having a first input terminal and a first output terminal, said first main signal line being a conductive pattern formed on a second dielectric layer laminated on the first dielectric layer;

a coupling signal line having a coupling terminal and an isolation terminal, said coupling signal line being a conductive pattern formed on a third dielectric layer laminated on the second dielectric layer;

a second main signal line having a second input terminal and a second output terminal, said second main signal line being a conductive pattern formed on a fourth dielectric layer laminated on the third dielectric layer; and a second ground pattern formed on a fifth dielectric layer laminated on the fourth dielectric layer;

wherein the coupling signal line has overlapping areas with the first main signal line and the second main signal line to independently control coupling coefficients of the coupling signal line with the first and second main signal lines, respectively.

2. The dual band coupler according to claim 1, wherein the third dielectric layer has a different thickness from the fourth dielectric layer.

3. The dual band coupler according to claim 1, wherein at least one of the second, third, and fourth dielectric layers comprises a plurality of layers.

4. The dual band coupler according to claim 3, wherein the conductive patterns of at least one of the first main signal line, the coupling signal line and the second main signal line are formed respectively on upper sides of said plurality of layers and connected to each other through conductive via-holes.

5. The dual band coupler according to claim 1, further comprising a shielding pattern for preventing electromagnetic interference between the first and second main signal lines, said shielding pattern being formed on the third dielectric layer and electrically isolated from the coupling signal line.

6. A dual band coupler, comprising:

a first ground pattern formed on a first dielectric layer;

a first main signal line having a first input and a first output terminal, said first main signal line being a conductive pattern formed on a second dielectric layer laminated on the first dielectric layer;

a coupling signal line having a coupling terminal and an isolation terminal, said coupling signal line being a conductive pattern formed on a third dielectric layer laminated on the second dielectric layer;

a second main signal line having a second input and a second output terminal, said second main signal line being a conductive pattern formed on a fourth dielectric layer laminated on the third dielectric layer; and a second ground pattern formed on a fifth dielectric layer laminated on the fourth dielectric layer;

wherein the third dielectric layer comprises at least three layers comprising:

a first layer which has the coupling terminal and on which a first conductive pattern is formed;

a second layer which has the isolation terminal and on which a second conductive pattern is formed; and a third layer which is formed between the first layer and the second layer and on which a third conductive pattern connecting the first conductive pattern to the second conductive pattern is formed, wherein said first, second, and third conductive patterns are connected to each other through via-holes.

7. The dual band coupler according to claim 6, further comprising a shielding pattern for preventing electromagnetic interference between the first and second main signal lines, said shielding pattern being formed around the third conductive pattern on the third layer and electrically isolated from the third conductive pattern.

8. The dual band coupler according to claim 7, wherein the shielding pattern comprises two ground terminals.

9. A dual band coupler, comprising:

a first main signal line having a first input terminal and a first output terminal, said first main signal line being formed on a first dielectric layer;

a coupling signal line having a coupling output terminal and an isolation output terminal, said coupling signal line being formed on a second dielectric layer laminated on the first dielectric layer;

a second main signal line having a second input terminal and a second output terminal, said second main signal line being formed on a third dielectric layer laminated on the second dielectric layer; and a ground pattern that is formed on the second dielectric layer and electrically isolated from the coupling signal line;

wherein the coupling signal line has overlapping areas with the first main signal line and the second main signal line to independently control coupling coefficients of the coupling signal line with the first and second main signal lines, respectively.

10. The dual band coupler according to claim 9, wherein at least one of the first, second, and third dielectric layers comprises a plurality of layers.

11. A dual band coupler, comprising:

a first main signal line having a first input and a first output terminal, said first main signal line being formed on a first dielectric layer;

a coupling signal line having a coupling output terminal and an isolation output terminal, said coupling signal line being formed on a second dielectric layer laminated on the first dielectric layer;

a second main signal line having a second input and a second output terminal, said second main signal line being formed on a third dielectric layer laminated on the second dielectric layer; and a ground pattern formed on the second dielectric layer and electrically isolated from the coupling signal line;

wherein the second dielectric layer comprises at least three layers comprising:

a first layer which has the coupling terminal and on which a first conductive pattern is formed;

a second layer which has the isolation terminal and on which a second conductive pattern is formed; and a third layer which is formed between the first and second layers and on which a third conductive pattern connecting the first conductive pattern to the second conductive pattern is formed, said first, second, and third conductive patterns being connected to each other through via-holes.

12. The dual band coupler according to claim 11, wherein the ground pattern is formed around the third conductive pattern on the third layer, is separated from the third conductive pattern, and comprises two ground terminals.

13. A dual band coupler, comprising:

a laminated structure comprising a plurality of dielectric layers stacked one upon another;

a first main signal conductive pattern being formed on a lower dielectric layer of said laminated structure;

a coupling signal conductive pattern being formed on a middle dielectric layer of said laminated structure; and a second main signal conductive pattern being formed on an upper dielectric layer of said laminated structure;

wherein the coupling signal conductive pattern is electrically isolated from the first and second main signal conductive patterns.

14. The dual band coupler according to claim 13, further comprising a ground conductive pattern formed on at least one of a lowermost layer and an uppermost layer of said laminated structure.

15. The dual band coupler according to claim 13, wherein a distance, in a thickness direction of said laminated structure, between the first main signal conductive pattern and the coupling signal conductive pattern is different from that between the second main signal conductive pattern and the coupling signal conductive pattern.

16. The dual band coupler according to claim 13, further comprising a shielding conductive pattern for preventing electromagnetic interference between the first and second main signal conductive patterns;

said shielding conductive pattern being electrically isolated from the coupling signal conductive pattern and formed on a dielectric layer of said laminated structure that is disposed between said lower and upper layers.

17. The dual band coupler according to claim 13, wherein the middle dielectric layer comprises at least two layers comprising:

a first layer on which a first pattern of said coupling signal conductive pattern is formed; and a second layer which is positioned above said first layer and on which a second pattern of said coupling signal conductive pattern is formed; and said first and second patterns being electrically connected to each other through via-holes.

18. The dual band coupler according to claim 17, wherein the middle dielectric layer further comprises a third layer which is formed between the first and second layers and on which a third pattern of said coupling signal conductive pattern that electrically connects the first pattern to the second pattern is formed;

said further comprising a ground conductive pattern for preventing electromagnetic interference between the first and second main signal conductive patterns, wherein the ground conductive pattern is formed around the third pattern on the third layer and electrically isolated from the third pattern.

19. The dual band coupler according to claim 13, wherein an entirety of the first main signal conductive pattern is positioned below said coupling signal conductive pattern; and an entirety of the second main signal conductive pattern is positioned above said coupling signal conductive pattern.

20. The dual band coupler according to claim 13, wherein a coupling coefficient between said coupling signal conductive pattern and any of said first and second main signal conductive patterns is greater than a coupling coefficient between said first and second main signal conductive patterns.

* * * * *